United States Patent [19]

McCoy et al.

[11] 4,411,426

[45] Oct. 25, 1983

[54] MULTI-PURPOSE EXERCISE IMPLEMENT

[75] Inventors: Kenneth H. McCoy, Santa Monica, Calif.; John Romain, 1629 Veteran, Los Angeles, Calif. 90074

[73] Assignee: John Romain, Los Angeles, Calif.

[21] Appl. No.: 278,637

[22] Filed: Jun. 29, 1981

Related U.S. Application Data

[63] Continuation-in-part of Ser. No. 145,424, May 1, 1980, abandoned.

[51] Int. Cl.[3] ..... A63B 21/00

[52] U.S. Cl. ..... 272/126; 272/143; 254/394

[58] Field of Search ..... 272/75, 900, 126, 116, 272/125, 143, 137, 138, 142, 74; 46/47, 51, 52; 119/153, 109; 254/394, 403-410

[56] References Cited

U.S. PATENT DOCUMENTS

| | | | |
|---|---|---|---|
| 259,576 | 6/1882 | Norcross | 254/450 |
| 774,738 | 11/1904 | Chavez | 272/126 |
| 1,382,520 | 6/1921 | Lundene | 119/153 |
| 1,478,999 | 1/1924 | Johnson | 119/153 |
| 1,672,823 | 6/1928 | McMillan | 254/394 |
| 3,966,204 | 6/1976 | Dubach | 272/73 |
| 4,026,549 | 5/1977 | Gunn | 272/137 |
| 4,047,714 | 9/1977 | Powell | 272/126 |
| 4,195,835 | 4/1980 | Hinds | 272/143 |
| 4,205,839 | 6/1980 | Best | 272/126 |

FOREIGN PATENT DOCUMENTS

| | | | |
|---|---|---|---|
| 356572 | 7/1922 | Fed. Rep. of Germany | 272/126 |
| 427890 | 4/1926 | Fed. Rep. of Germany | 272/DIG. 8 |
| 508253 | 10/1920 | France | 272/DIG. 8 |
| 1111862 | 11/1955 | France | 272/126 |
| 354011 | 6/1961 | Switzerland | 272/75 |

*Primary Examiner*—Richard J. Johnson

*Attorney, Agent, or Firm*—Cislo, O'Reilly & Thomas

[57] ABSTRACT

A multi-purpose exercise implement for physical conditioning wherein a flexible hand line is provided with handles at each end, wherein in one embodiment and at least one of the handles consists of a tube with one end of the hand line extending into the tube and secured adjacent the other end of the tube handle so that the hand line may be readily removed from the handle or a hand line loop may be made quickly at the end of the handle to provide a loop handle. In another embodiment, the device is depicted utilizing a unique pulley for additional uses for a myriad of physical exercises.

9 Claims, 10 Drawing Figures

MULTI-PURPOSE EXERCISE IMPLEMENT

REFERENCE TO RELATED APPLICATION

This application is a continuation-in-part application of application Ser. No. 06/145,424 filed May 1, 1980 now abandoned, and having the same inventors as herein.

BACKGROUND OF THE INVENTION

The present invention relates generally to exercise implements to improve physical fitness, and more particularly to such exercise implements which incorporate flexible ropes or hand lines.

Many rope type exercise implements may be found on the market to assist one in conducting different physical exercises toward physical fitness. However, they all tend to be either rather expensive or unversatile in construction. It is a principle object of the present invention to eliminate these disadvantages and to provide a multi-purpose exercise implement for physical conditioning which is easily and readily adaptable to many different forms so that the exerciser may perform an even greater variety of exercises in order to properly exercise all muscles of the body.

OBJECTS AND SUMMARY OF THE INVENTION

It is an object of the invention to provide a unique exercise device having a myriad of uses.

It is another object of the invention to provide an exercise device utilizing simple components which in combination unite to form a device capable of a multiplicity of end uses and functions.

It is still another and further object of the invention to provide an exercise device that is relatively simple in construction employing relatively unsophisticated elements that are easily associated with a device that may be used under a variety of conditions for a variety of desired end functions.

It is still another and even further object of the invention to provide an exercise device using lines or ropes having handles on the ends thereof for use in conjunction with a novel pulley member that permits a variety of exercises.

It is still another even further more specific object of the invention to provide an exercise system having versatile elements for use in exercising selected muscle groups of the human body.

The multi-purpose exercise implement or device of the present invention generally comprises a flexible hand line with handles at each end. In one embodiment, at least one of the handles consists of a tube with one end of the hand line extending into one end of this tube and then being secured to the tube adjacent the other end thereof. In this fashion, a portion of the hand line may be drawn through the tube handle at the end where the hand line is secured to form a flexible loop at the end of the handle to provide an additional loop handle for one's feet or hands, etc.

A cap may be utilized to cover the aforesaid other end of the tube handle, and the cap is thus provided with two spaced apertures therethrough. One end of the hand line passes from within the tube handle through one of the apertures and thence back into the interior of the tube to the other aperture where it is knotted or otherwise secured so that it cannot be pulled back through this latter aperture. Thus, a loop is readily formed at the capped end of the handle by pulling additional hand line from within the interior of the tube. This cap may be either permanently secured or removable as desired.

In another embodiment of the present invention, two flexible hand lines may be utilized with circular handles at opposite ends thereof together with a double pulley having non-aligned pulley axes for the respective pulleys or a single pulley member having spaced roller members to receive individual lines in separate fashion. The hand lines pass through the respective pulleys or spaced roller members. In this fashion, additional and versatile exercises may be performed with the implement using one or more persons.

Other objects and advantages will become apparent from the following description and claims.

BRIEF DESCRIPTION OF THE DRAWINGS

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figure 1:
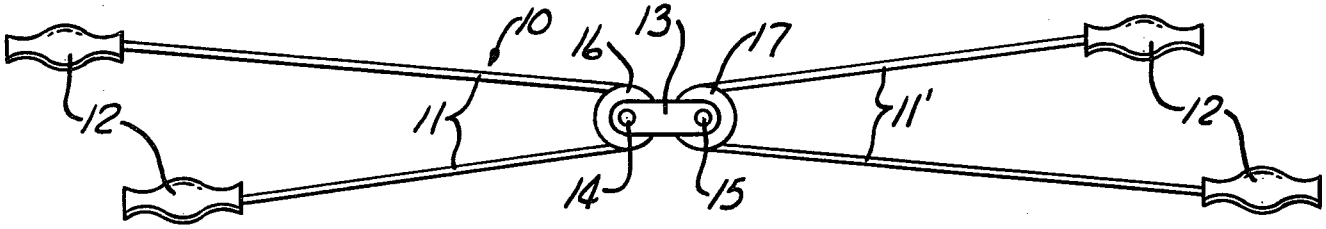
FIG. 1 is a top view of one embodiment of the multi-purpose exercise implement of the present invention incorporating a double pulley.

Referring to FIG. 1, the multi-purpose implement 10 of the present invention basically consists of two flexible hand lines 11 and 11' which have handles 12 at each end. A double pulley 13 is illustrated which has non-aligned pulley axes 14 and 15 for pulley wheels 16 and 17 respectively. The hand lines 11 and 11' respectively pass over pulley wheels 16 and 17.

Pulley 13 may be of any suitable material such as metal or plastic, and hand lines 11 and 11' may be rope, synthetic rope or any other suitable flexible line, and handles 12 may be molded of plastic or formed of wood, etc. and are either firmly secured to the ends of the hand lines 11 and 11' or may be removably secured thereto.

With the exercise implement of the present invention, a number of different exercises may be performed. Two people may participate, or even four people may participate in working the lines back and forth through the pulley 13. Also, this embodiment of the exercise implement of the present invention may be readily utilized in tugging games such as those illustrated in patent application Ser. No. 37,109 filed May 3, 1979 in the name of Kenneth H. McCoy, one of the named inventors herein.

With or without the use of the pulley 13 illustrated in this embodiment, it is many times desirable to have a loop handle instead of the handles 12 for hand grasping. Flexible loop handles may be readily utilized to position around one's foot for different exercises or around one's arms, or to insert one's hands therein instead of holding the handle 12. A novel method of providing the capability for such loop handles is illustrated in FIGS. 2 and 3.

Figure 2:
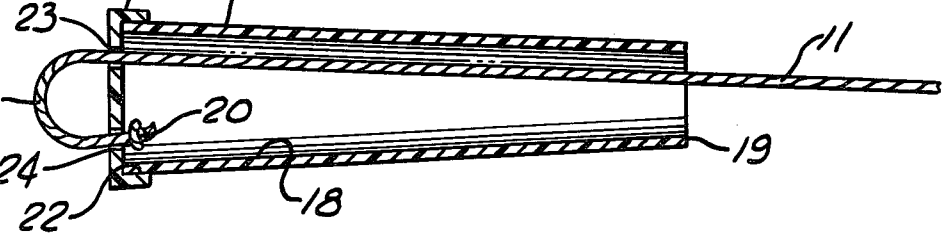
FIG. 2 is a view in side elevation with portions in vertical section illustrating another embodiment of the present invention wherein the hand line of the exercise implement may be varied to form a hand or foot loop at the end of the handle illustrated.
Figure 3:
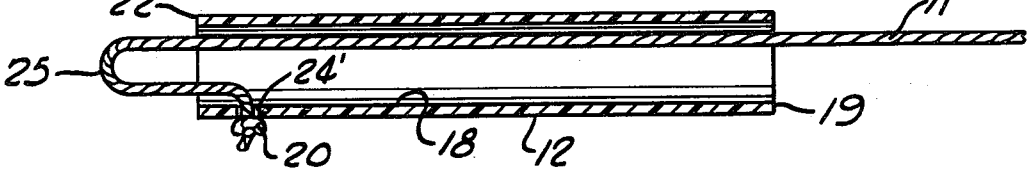
FIG. 3 is a view in side elevation and in partial vertical section illustrating a variation in the structure of the exercise implement illustrated in FIG. 2.

With particular reference to FIG. 2, the handle 12 consists of a hollow tube having a hollow passage 18 therethrough. The free end of hand line 11 extends into one end 19 of tube 12 and is secured to the tube adjacent the other end thereof as indicated at 20.

In this embodiment, a cap 21 covers the other end 22 of tube 12, and the cap 21 is provided with two spaced apertures 23 and 24. One end of the hand line 11 passes through aperture 23 from the interior of tube 12 and then loops around and passes back into the interior of tube 12 through the other aperture 24, and then the end 20 of hand line 11 is enlarged so that it cannot pass back through aperture 24. In this illustration, the enlargement 20 is in the form of a knot which may be untied any time if it is desired to completely remove the hand line from the handle 12.

A foot, arm or hand loop 25 is thus readily formed to any desired size at the end 22 of handle 12 by merely pulling more line 11 through aperture 23. Thus, loop 25 is readily adapted for insertion of a foot, arm, etc. to conduct any particular exercise or game with the exercise implement.

Tubular handle 12 and cap 21 will generally be molded of plastic in this instance, and cap 21 may be either temporarily or permanently secured to handle 12 by any convenient or conventional means.

FIG. 3 illustrates a simplified version of the handle illustrated in FIG. 2, wherein the flexible line loop handle 25 is formed in the same fashion, but in this instance, cap 21 is completely eliminated and instead the aperture 24 is provided in the form of aperture 24' through the side wall of tube 12 adjacent end 22 thereof.

Figure 9:
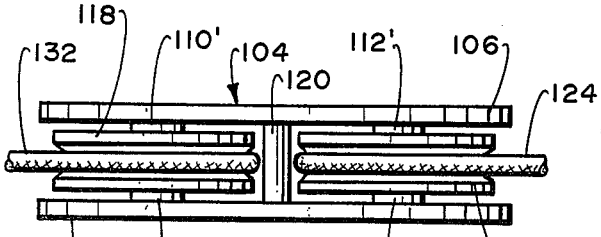
FIG. 9 is a front view of the pulley member shown in FIG. 7.
Figure 10:
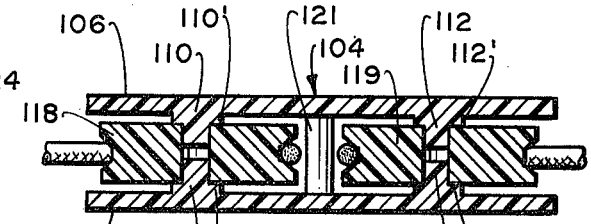
FIG. 10 is a cross-sectional view of the pulley member taken along the line 10—10 of FIG. 7.

Referring now to FIGS. 4–10, inclusive, an alternative embodiment of the invention 102 is illustrated wherein, in this particular instance, a sheave-like member 104 is utilized as the pulley member comprising opposed annular side walls 106 and 108, each having spaced stub-shafts 110, 112 with respect to side wall 106 and side wall 108 having the spaced stub-shafts 114 and 116 having the configuration illustrated in FIG. 10 so that a collar or base of wider diameter is provided, viz. 110', 112', 114' and 116', so as to be able to mount roller members 118 and 119 in freely rotatable relationship and being spaced and in side-by-side relationship as best seen in FIGS. 9 and 10.

The members 106 and 108 may be integrally molded as of plastic and each provided with a spacer member 120 and 121 spaced 180° apart for purposes that will become apparent with regard to maintaining separation of the lines of the alternative embodiment 102.

The roller members are of pulley-like configuration, having circumferential recess of conventional design so as to receive the lines as will be described.

Figure 4:
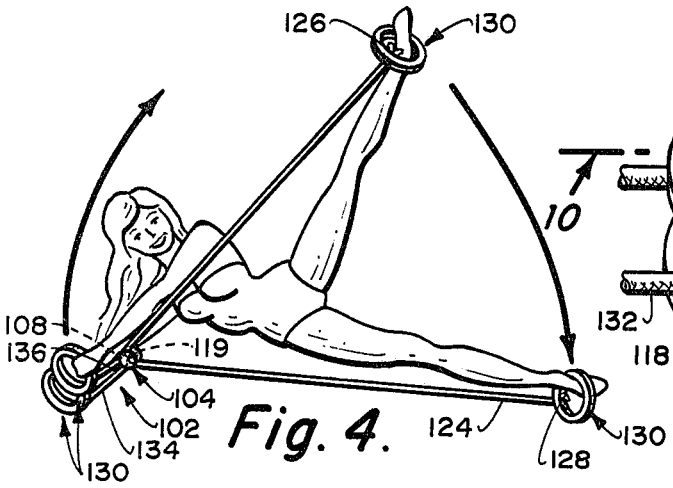
FIG. 4 is a view of another embodiment of the invention incorporating the circular or ring handle members and using a unitary pulley member having the special roller members therein.
Figure 7:
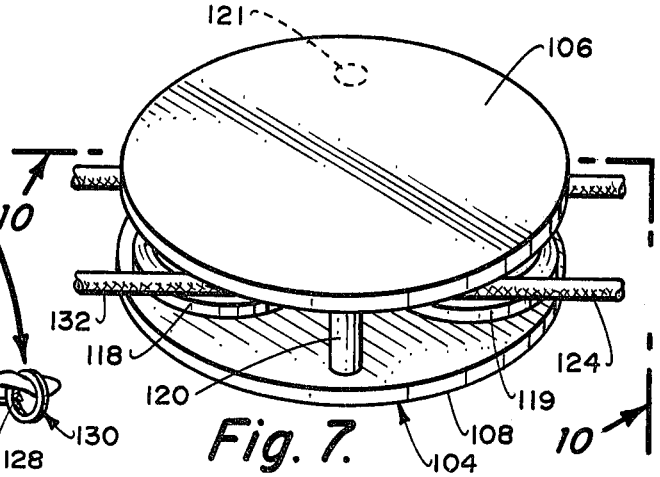
FIG. 7 is a perspective view of an alternate pulley member of the invention.

Referring to FIG. 4, it will be noted that the alternative device 102 has a first line or rope 124 threaded through the shreave-like member 104 and, more specifically, through and around the one pulley member 119 so as to provide first and second termini 126 and 128 terminating in handle members 130.

The second line, or rope, 132 is threaded through roller or pulley member 118 in separated fashion from line 124 by reason of being retained within the grooved exterior or circumferential surface of the roller 118 and kept in separated manner because of post or boss members 120 and 121.

The line 132 terminates in the third and fourth termini 134 and 136, each of which also have attached thereto annular handle member 130. It will be noted that the lines 124 and 132 are retained in opposed relationship and in side-by-side position within the shreave-like member 104 by reason of the constructural configuration thereof.

Each of the handle members 130 are fabricated of integrally molded plastic wherein the handle members have an annular general configuration of a size sufficient to receive a human hand or foot (see FIG. 4) in secure relationship. The handle member 130 is formed so as to have an exterior wall or surface 138 and an interior surface or wall 140 and is of generally I-shaped configuration in cross-section, with an interior web 142 terminating in integral extending flanges 144 and 146 forming the exterior and interior wall surfaces 138 and 140 respectively.

Figure 5:
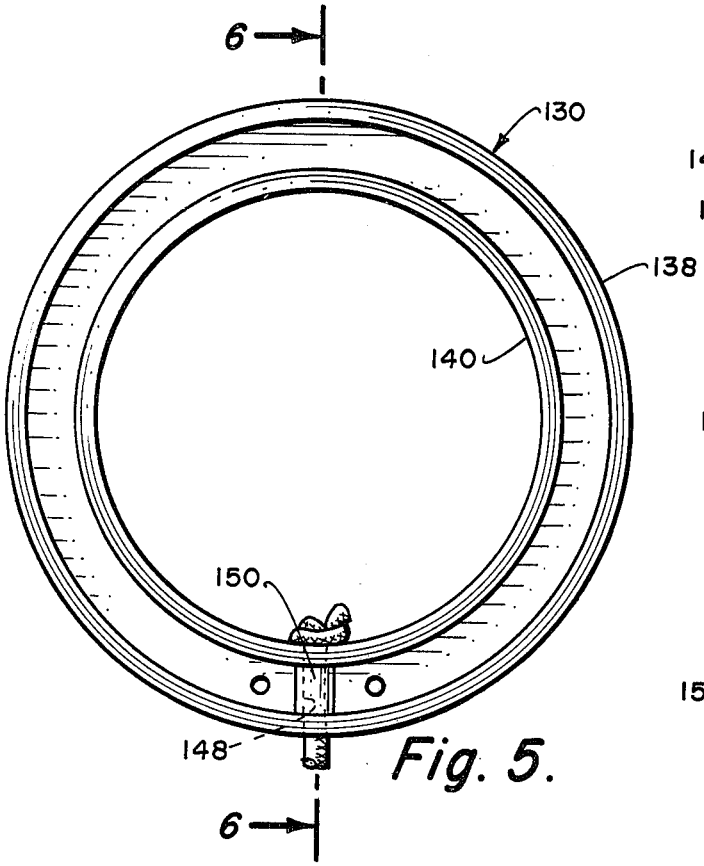
FIG. 5 is a plan view of the annular handle member of another embodiment of the invention.
Figure 6:
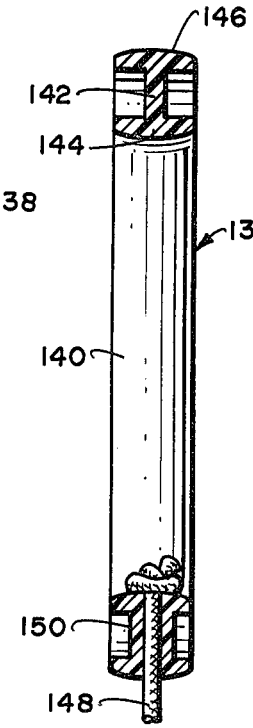
FIG. 6 is a view taken along the line 6—6 of FIG. 5.
Figure 8:
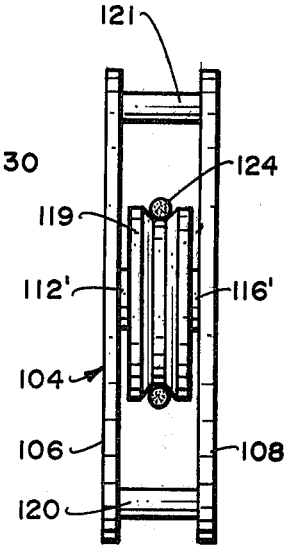
FIG. 8 is a side view of the pulley member shown in FIG. 7.

At one portion of the handle member 130 is provided a reenforced bore 148 so as to receive the line or rope termini in releasable fashion. As seen in FIGS. 5 and 6, the bore 148 is reenforced about the circumference thereof by reason of reenforcement wall 150 so as to insure structural strength to handle member 130 because of the stresses that would be put upon the members 130 when using the device 102 for the various exercises to which the versatile exercise device of the invention may be put. Thus, as seen in FIGS. 5 and 6, the lines are threaded through the reenforced bore 138 and simply knotted at the end so as to retain the lines in secure relationship with respect to handle members 130. However, because of the simplicity and the releasable fashion of securement of lines and handles 130, the line lengths of considering the first, second, third and fourth termini, lengths may be varied in order to meet a variety of needs in utilization of the exercise devices of this invention.

Thus, as seen in FIG. 4, termini ends 134 and 136 are much shorter than the termini ends 126 and 128 so as to enable an exerciser to utilize the alternative device of the invention 102 in the manner shown in FIG. 4. Thus, one of ordinary skill in the exercise art will readily appreciate the fact that the exerciser as pictured in FIG. 4 will be able to exert sufficient leverage in order to perform the various exercises capable of being performed with the device.

For convenience, where the device is intended to be utilized with at least one other, the lines 124 and 132 may be of different color, i.e. yellow and black, so as to enable the users of the device to quickly recognize which handle members 130 should be grasped by them in the performance of the various exercises.

Many different exercises and games may be performed with the exercise implement of the present invention. For example, if two people are utilizing the devices illustrated in FIGS. 1 or 4, the participants may begin by grasping the handles and hold them to their respective chests to get proper spacing with the lines stretched between the opponents. Then, through pulling or giving slack to the ropes or lines 11 and 11' or 124 and 132, the object is to force the opponent to move his feet before he makes you move. Four people may also play and/or exercise in the same fashion.

It will be noted to one familiar with exercise that the implements of the invention are highly versatile and may be used for various exercises emphasizing particular muscle groups. For example, for the device pictured in FIG. 1, the ends of one hand line, for example 11', may be secured to a stationary anchor such as a door knob and the other hand line 11 may be utilized through the pulley system to conduct exercising by either pulling with the hands or feet or hands and feet both. When using the feet, flexible loops 25 may be readily formed and the feet inserted. It is obvious that such exercises may be conducted from any position to exercise any particular muscle group of the body. Also, the neck, legs, arms, torso, feet, etc. may be readily attached to the hand line through the use of the loops 25 for any particular exercise desired. It is also obvious that two or more people may participate the same implements to perform physical exercises of varying kinds.

While the embodiments of the invention have been described with some particularity, it will be obvious to those of ordinary skill in the art that various modifications and changes may be made, but all such modifications and changes will not depart from the essence and spirit of the hereindisclosed invention and all such changes are intended to be covered by the appended claims.

We claim:

1. A multi-purpose exercise implement comprising a pair of flexible hand lines having annular handles at opposite ends; a single double pulley having non-aligned pulley axes for the respective pulleys, the pulleys being of equal size and being mounted in side-by-side relationship and being wholly contained within an annular sheave-like member having round outer walls and an interior rigid separator to maintain said hand lines in separated position, said hand lines respectively passing over respective of said pulleys.

2. A versatile exercise device comprising the combination: a sheave-like member having spaced, annular and opposed side walls defining a compartment mounting therebetween in free rotational separated fashion first and second equally sized, roller members in side-by-side relationship; a first line threaded through said first roller member on the same side thereof and terminating in first and second line termini, each mounting a first and second handle member in easily releasable fashion; a second line threaded through said second roller member in opposed relationship to said first line and being on the same side of said second roller member and terminating in third and fourth line termini, each mounting a third and fourth handle member in easily releasable fashion, said handle members being annular in configuration, said spaced annular and opposed side walls having a diameter larger than said roller members to completely house the same and having rigid spacer members therebetween to maintain said opposed side walls in spaced relationship.

3. The exercise device in accordance with claim 2, wherein said handle member has an I configuration in cross-section and is of integral construction.

4. The exercise device in accordance with claim 3, wherein each of said handle members has a bore extending from an exterior surface through an interior surface and a reenforcement about the bore and said bore receiving said line termini.

5. The exercise device in accordance with claim 4, wherein the line termini extending through said bores is knotted with a single knot on the interior inside surface of said handle member.

6. The exercise device in accordance with claim 5, wherein said handle member has an integral web terminating in opposed flanges and is of molded plastic.

7. The exercise device in accordance with claim 2, wherein said sheave-like member is of molded, low-friction synthetic material.

8. The exercise device in accordance with claim 7 wherein opposed spacer or boss-like members are spaced 180° apart between the opposed side walls and act to separate said first and second lines threaded through said roller members.

9. The exercise device in accordance with claim 8, wherein said lines and handles are color coded for ease of identification.

* * * * *